US010174755B2

(12) United States Patent
Geither et al.

(10) Patent No.: US 10,174,755 B2
(45) Date of Patent: Jan. 8, 2019

(54) COMPRESSOR HEAD ASSEMBLY WITH DISCHARGE VALVE

(71) Applicant: Bendix Commercial Vehicle Systems LLC, Elyria, OH (US)

(72) Inventors: Jeffrey M Geither, North Ridgeville, OH (US); Padraig B Yeats, Avon Lake, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 108 days.

(21) Appl. No.: 15/148,352

(22) Filed: May 6, 2016

(65) Prior Publication Data

US 2017/0321693 A1 Nov. 9, 2017

(51) Int. Cl.
*F04B 53/10* (2006.01)
*F04B 39/10* (2006.01)
*F04B 39/12* (2006.01)

(52) U.S. Cl.
CPC ..... *F04B 53/1047* (2013.01); *F04B 39/1066* (2013.01); *F04B 39/1073* (2013.01); *F04B 39/125* (2013.01)

(58) Field of Classification Search
CPC ..... F04B 53/1047; F04B 39/1073; F04B 39/1066; F04B 39/125
USPC ..... 137/855
See application file for complete search history.

(56) References Cited

U.S. PATENT DOCUMENTS 3,934,967 A * 1/1976 Gannaway ..... F04B 27/0882 417/271
5,078,582 A * 1/1992 Ohbayashi ..... F04B 39/10 137/512.15
5,178,183 A 1/1993 Kim
5,456,287 A 10/1995 Leu
5,558,508 A 9/1996 Sasano
5,733,108 A * 3/1998 Riffe ..... F04B 39/0011 417/542
5,873,707 A * 2/1999 Kikuchi ..... F04C 28/12 417/309

(Continued)

FOREIGN PATENT DOCUMENTS

GB 1246256 9/1971

OTHER PUBLICATIONS

Bendix Commercial Vehicle Systems LLC, "Bendix BA-921 Compressor: Standard and Closed Room" SD-01-690 Service Data Sheet, Oct. 2007, Bendix Commercial Vehicle Systems LLC, Elyria OH USA.

*Primary Examiner* — P. Macade Nichols
(74) *Attorney, Agent, or Firm* — Cheryl L. Greenly; Brian E. Kondas; Eugene E. Clair

(57) ABSTRACT

An apparatus for a compressor head assembly with a discharge valve comprises a valve plate having a first face and a second face, wherein at least one cavity is located on the second face and a reed valve assembly sized to be contained in the at least one cavity. The reed valve assembly comprises a reed valve plate with at least one orifice, the reed valve plate selected according to a rated compressor displacement a retainer portion; and a reed retained by the retainer portion proximate to the reed valve plate and oriented to inhibit air flow through the at least one orifice in a closed state. The reed valve assembly is removably secured to the valve plate to facilitate changing the characteristics of the reed valve assembly without changing the valve plate.

20 Claims, 6 Drawing Sheets

(56) References Cited

U.S. PATENT DOCUMENTS

| | | | | |
|---|---|---|---|---|
| 5,899,218 | A * | 5/1999 | Dugan | F15C 5/00 137/1 |
| 6,053,713 | A | 4/2000 | Brown | |
| 6,116,874 | A | 9/2000 | Nation | |
| 6,357,473 | B1 * | 3/2002 | Porter | B60H 1/249 137/512.15 |
| 2007/0251512 | A1 | 11/2007 | Wallington | |
| 2008/0063551 | A1 * | 3/2008 | Cornwell | F04B 39/0027 417/571 |
| 2009/0028733 | A1 | 1/2009 | Duwel | |
| 2016/0053891 | A1 | 2/2016 | Yeats | |
| 2016/0177936 | A1 | 6/2016 | Harte | |

* cited by examiner

COMPRESSOR HEAD ASSEMBLY WITH DISCHARGE VALVE

BACKGROUND

The present invention relates to embodiments of an air compressor head assembly for use in air brake systems for commercial vehicles. Engine driven compressors, such as those used on heavy vehicles, function continuously while the engine is in operation. When a piston inside the compressor compresses the air, a discharge valve in a cylinder head will open and allow the air to pass downstream of the compressor to be treated and stored. This discharge valve may cycle hundreds of times per minute. The surface on which the discharge valve seats, such as a machined portion of a valve plate, will be subjected to the cycling of the discharge valve and may wear quickly. Extreme temperatures caused by air compression may cause thermal expansion between the discharge valve mounting and the valve plate if the discharge valve and valve plate are constructed of different materials, causing a retainer or bridge of the discharge valve to be stressed. Additional sealing and air directing features must be machined into a separate cooling or baffle plate and additional gaskets must be added when the valve plate is dedicated to the mounting of the discharge valve. Each layer of a compressor head assembly provides an opportunity for air leakage and causes additional potential for distortion of the crankcase bore. Therefore, there is a desire for an improved air compressor head assembly.

SUMMARY

Various embodiments of an apparatus for a compressor head assembly comprise a valve plate having a first face and a second face, wherein at least one cavity is located on the second face and a reed valve assembly sized to be contained in the at least one cavity. The reed valve assembly comprises a reed valve plate with at least one orifice, the reed valve plate selected according to a rated compressor displacement a retainer portion; and a reed retained by the retainer portion proximate to the reed valve plate and oriented to inhibit air flow through the at least one orifice in a closed state. The reed valve assembly is removably secured to the valve plate.

Additional embodiments of a compressor head assembly include a valve plate having a first face, a second face, integral baffle features for separately directing coolant and air located on the first face, and at least one cavity located on the second face; a reed valve assembly sized to be contained in the at least one cavity; wherein the reed valve assembly comprises: a reed valve plate with at least one orifice, the reed valve plate selected according to a rated compressor displacement; a retainer portion; and a reed retained by the retainer portion proximate to the reed valve plate and oriented to inhibit air flow through the at least one orifice in a closed state. The reed valve assembly is removably secured to the valve plate.

In accordance with another aspect, a method of assembling a compressor head comprises selecting a reed valve plate corresponding with a rated compressor displacement; selecting a reed corresponding with a rated compressor displacement; fastening the reed and a retainer portion to the reed valve plate to create a reed valve assembly; and removably securing the reed valve assembly in a cavity of a valve plate of the compressor head.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION

Figure 1:
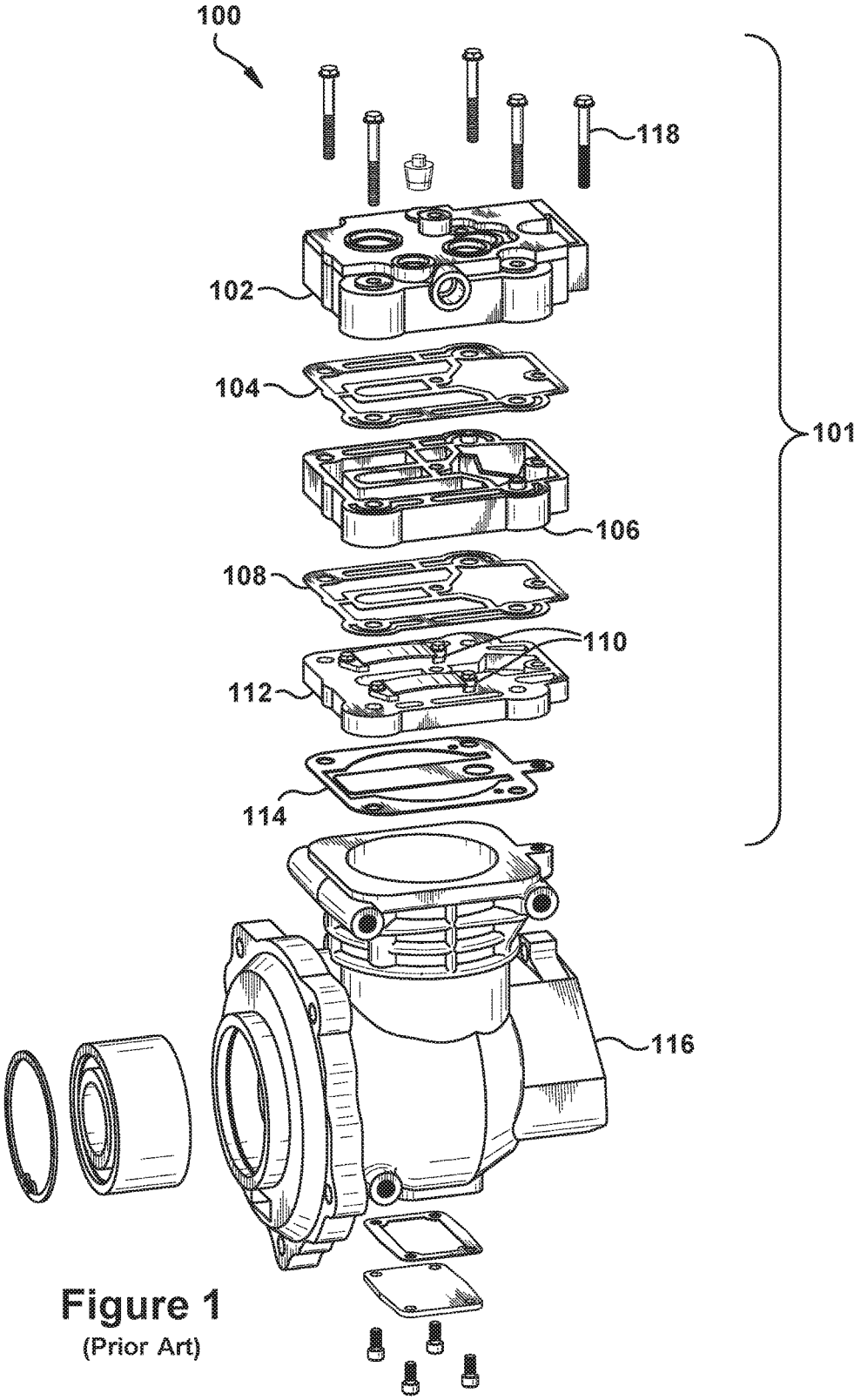
Figure 1 (Prior Art)
FIG. 1 illustrates an exploded view of a prior art compressor.

FIG. 1 illustrates a prior art compressor assembly 100. The prior art compressor assembly 100 may be a BA-921® compressor from Bendix Commercial Vehicle Systems LLC of Elyria Ohio, for example. The compressor assembly 100 includes a crankcase 116 containing pistons (not shown) for compressing air.

The crankcase 116 receives several components to construct the compressor head assembly 101 for directing intake air, coolant and compressed air. First, an inlet reed with an integral gasket 114 is positioned on top of the crankcase 116. A valve plate 112 is placed on top of the inlet reed gasket 114. The valve plate 112 has two reed valves 110 mounted on the top of the valve plate 112. A first head gasket 108 is placed on top of the valve plate 112. A cooling plate 106 is placed on top of the first head gasket 108 for directing coolant and air. A second head gasket 104 is placed on top of the cooling plate 106. A cylinder head 102 containing valving and additional air direction features is placed on top of the second head gasket 104.

Fasteners 118 are used to affix the cylinder head 102, the second head gasket 104, the cooling plate 106, the first head gasket 108, the valve plate 112 and the inlet reed gasket 114 to the top of the crankcase 116. This compressor head assembly 101 requires many steps to complete.

Figure 2A:
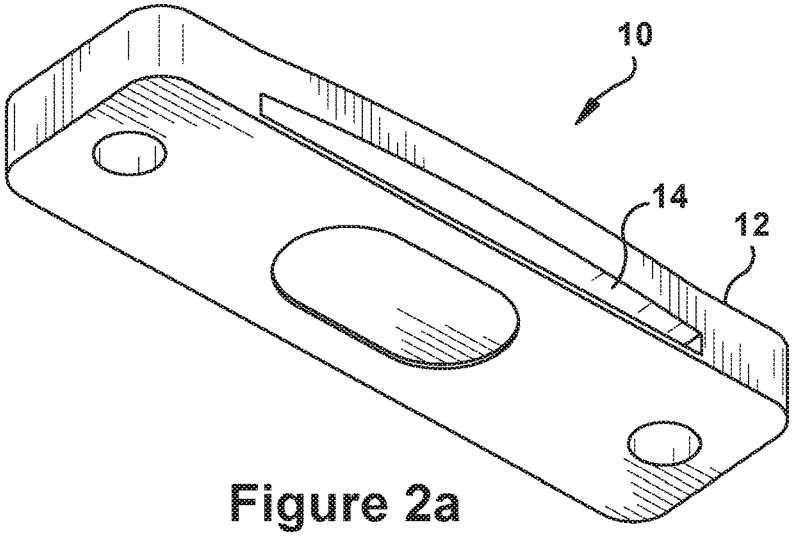
FIG. 2*a* illustrates a perspective view of a reed valve configured to be used in the invention.

FIG. 2*a* illustrates an example reed valve 10 for use in the invention. The reed valve 10 includes a reed 14. The reed 14 may be, for example, made of stamped steel or spring steel. In another example, a material having a Brinell hardness (HB) greater than 90 would be suitable for the reed 14. The reed 14 is contained in a retainer 12. In this example, the retainer 12 is in the form of a cartridge, which serves to prevent over-flexing of the reed and to maintain the reed in its installed position.

Figure 2B:
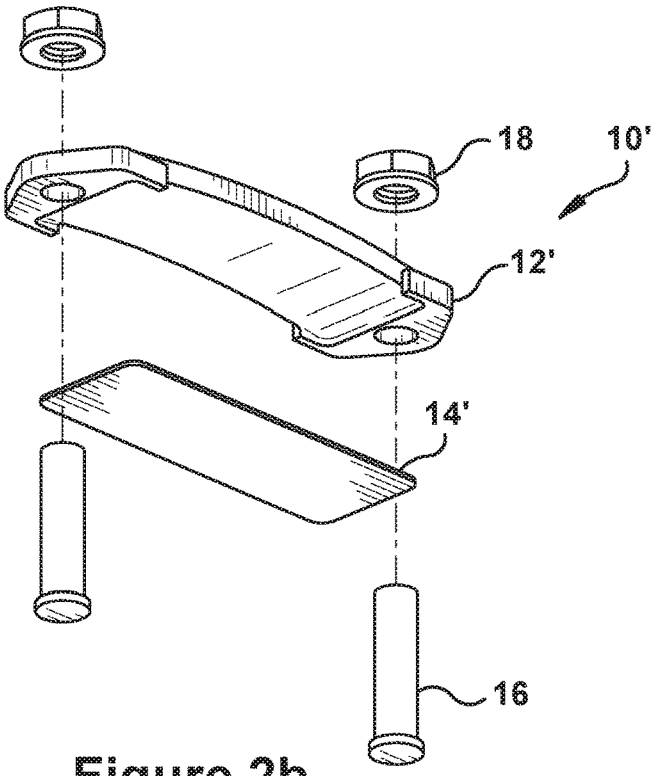
FIG. 2*b* illustrates an exploded view of another reed valve configured to be used in the invention.

FIG. 2*b* illustrates another example reed valve 10' for use in the invention. The reed valve 10' includes a retainer portion 12' and a reed 14'. The reed 14' is made of a relatively flexible material, such as stamped or spring steel. The retainer portion 12' serves to prevent over-flexing of the reed 14'. In this example, the reed 14' is contained by the retainer portion 12' via the fasteners 16 and nuts 18, but is not fastened directly to the retainer portion 12.

Figure 3:
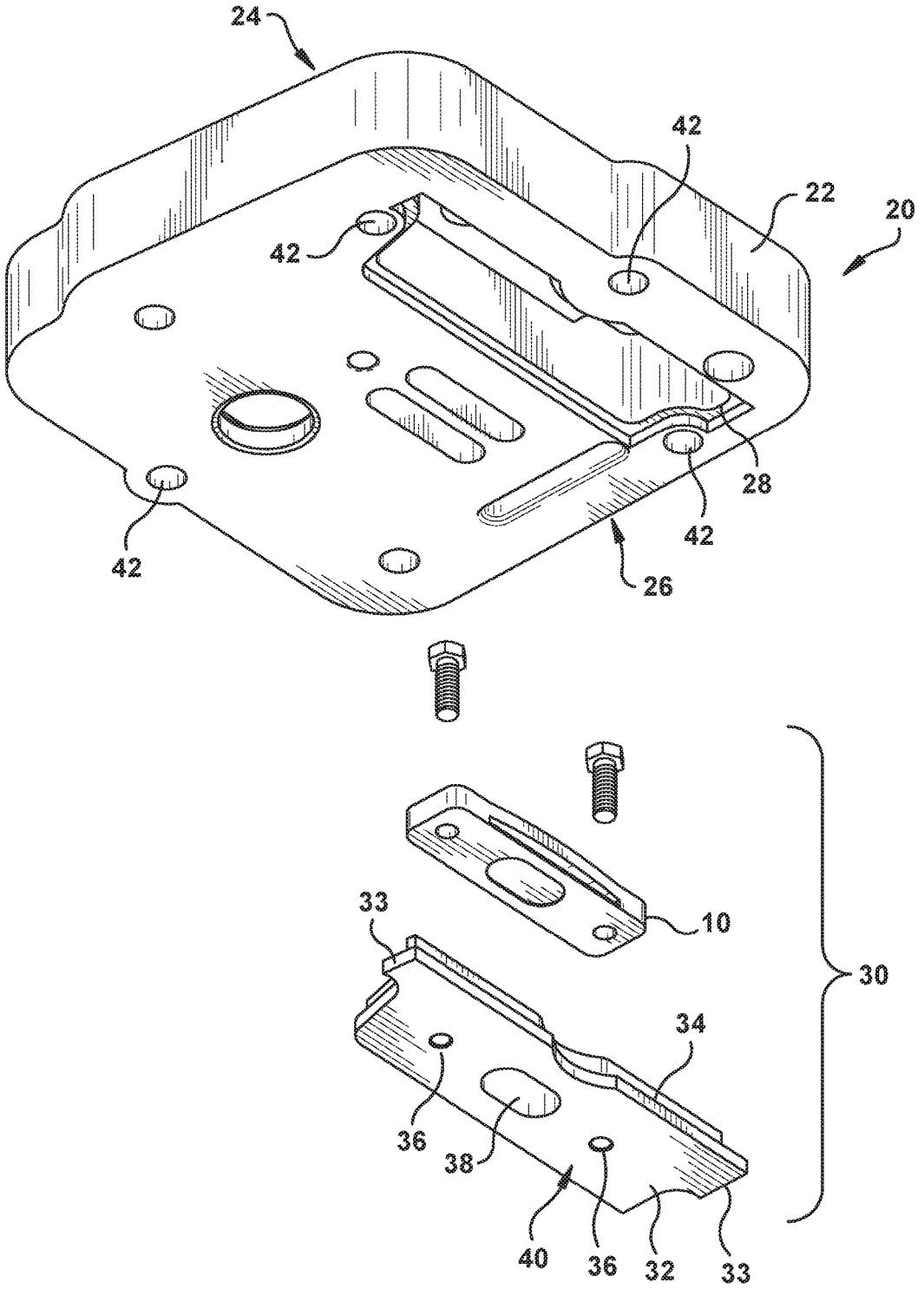
FIG. 3 illustrates an exploded view of the components of a valve plate assembly for a compressor head assembly according to an example of the invention.

FIG. 3 illustrates an exploded perspective view of a valve plate assembly 20 according to an example of the present invention. A valve plate 22 has a first face 24 and a second face 26. A cavity 28 is located on the second face 26. The cavity 28 is sized to receive a reed valve assembly 30. The cavity 28 is also shaped to ensure no interference with mounting holes 42 in the valve plate 22. The valve plate 22 is made of a lightweight and low cost material, such as aluminum, to keep the overall weight of the compressor low and to provide ease in casting.

The reed valve assembly 30 comprises the reed valve 10 and a reed valve plate 32. The reed valve plate 32 includes at least one orifice 38. The reed valve plate 32 is configured according to a rated compressor displacement. As the rated compressor displacement increases, the number of orifices may increase or the size of any one or all of the orifices may increase in order to increase air flow. Alternatively, both the number and size of the orifice may change based on the rated compressor displacement. In an example of a large displacement compressor, such as a compressor with a rated compressor displacement of about 425 cc, the at least one orifice 38 includes two separate orifices. The two separate orifices permit greater air flow through the reed valve assembly 30. In an example of a smaller displacement compressor, such as a compressor with a rated compressor displacement of about 360 cc, the at least one orifice 38 is a single orifice. The shape of the at least one orifice 38 can be changed as well to improve air flow based on the rated compressor displacement. The shapes may include oval, round or tapered shapes. The reed valve plate 32 has an outer face 40 through which the at least one orifice 38 passes.

The reed valve plate 32 includes flanges 33. The flanges 33 permit the thickness of the mating structure within the valve plate 22 to be decreased. However, the reed valve plate 32 may be constructed without the flanges 33. The reed valve plate 32 may be the only machined component in the valve plate assembly 20.

The reed valve plate 32 may be made of a relatively hard material, such as stamped steel. In another example, a material having a Brinell hardness (HB) of at least 90 is suitable for the reed valve plate 32. In a preferred assembly, the reed valve plate 32 is made of the same material or a material with similar hardness as the reed 14. The reed 14 may open and close up 3600 times per minute. When the reed valve plate 32 is the same material or a material with equivalent hardness as the reed 14, the reed valve plate 32 is able to withstand the wear caused by the millions of cycles of the reed 14 opening and closing against the reed valve plate 32 during a normal operation cycle of the compressor. In addition, when the reed valve plate 32 and the retainer 12 are made of the same material, such as stamped or spring steel, and are mounted to the valve plate 32 of the same or similar material, the components will change size similarly due to matching coefficients of thermal expansion, thus reducing stress and the possibility of failure of the retainer 12 or the reed 14. The reed valve assembly 30 may also comprise a sealing device, such as gasket 34.

Figure 4:
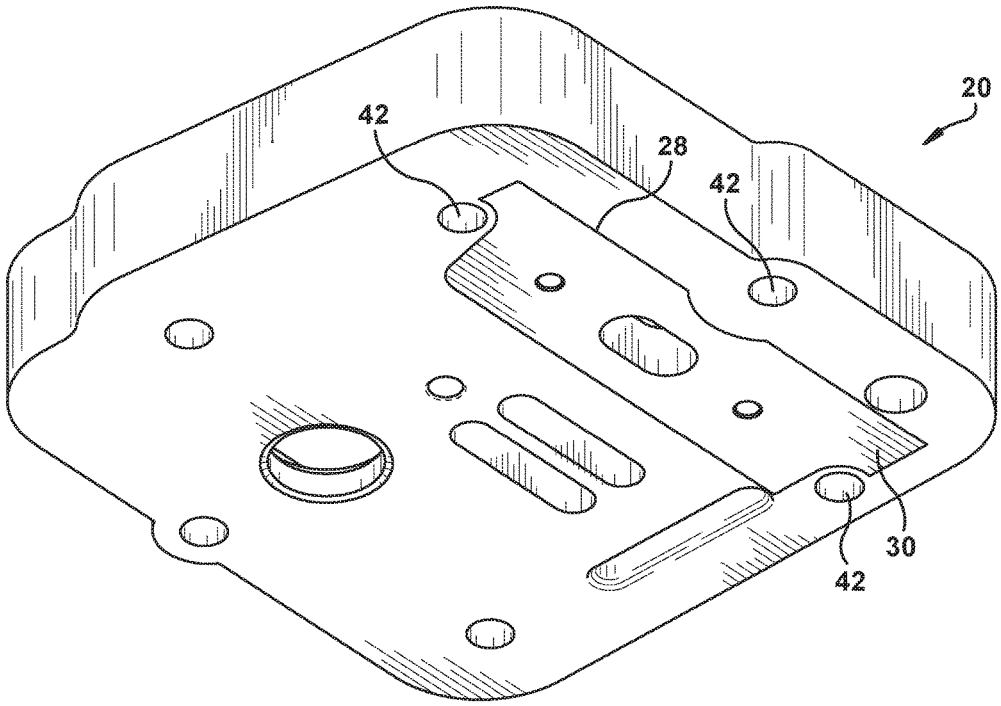
FIG. 4 illustrates a perspective view of the valve plate assembly when a reed valve assembly is installed.

FIG. 4 illustrates an assembled view of the valve plate assembly 20 where reed valve assembly 30 is installed in the cavity 28 of the valve plate 22. The shape of the reed valve plate 32 is complementary to the shape of the cavity 28. In this example, the reed valve assembly 30 may be installed with an interference fit into the cavity 28.

Alternatively, the reed valve assembly 30 can be held into the valve plate assembly 20 by another set of fasteners. In yet another embodiment, the reed valve assembly 30 is held in the valve plate assembly 20 by slightly deforming a portion of the valve plate 22 around the cavity 28. In yet another embodiment, the reed valve assembly 30 is held in place by a metal relocation feature. Once installation is complete, the lower face 40 of the reed valve plate 32 is substantially flush with the lower face 26 of the valve plate 22 no matter what fit method is used. When the reed valve plate 32 is substantially flush with the valve plate 22, dead air volume is minimized.

The completed valve plate assembly 20 is then ready to be assembled to the rest of the compressor (not shown). When the reed valve assembly 30 is interference fit into the valve plate assembly 20, no additional fasteners are needed to hold the reed valve assembly 30 in place while the valve plate assembly 20 is being mounted to the compressor. With the placement of the reed valve assembly 30 in the cavity 28 on the lower face 26 of the valve plate 22, additional features for sealing and directing air and coolant can be added in the valve plate 22. When additional features are added directly into the valve plate 22, other components of the compressor, such as a divider plate, a cooling plate or additional gaskets may be eliminated. The valve plate 22 is no longer required to be dedicated to hosting just a reed and a valve retainer as in prior compressor assemblies.

The valve plate 22 is generally made of a lightweight material, such as aluminum. The material of the valve plate 22 may be different than the material of the reed valve plate 32, which means there may be different expansion rates of material as the valve plate 22 and reed valve plate 32 are heated and cooled during operation of the compressor. Additionally, with the placement of the reed valve assembly 30 in the cavity 28 on the lower face 26, changes in thermal expansion will not cause the reed valve assembly 30 to loosen and be released from the valve plate 22 since the reed valve assembly 30 will already be restrained from movement against the compressor. The reed 14 and retainer 12 will not be affected by the thermal expansion of the valve plate 22 since they are mounted to the reed valve plate 32. Any air leakage due to thermal expansion will also be eliminated due to the gasket 34 on the reed valve plate 32.

Various embodiments of an apparatus for a compressor head assembly comprise a valve plate having a first face and a second face, wherein at least one cavity is located on the second face and a reed valve assembly sized to be contained in the at least one cavity. The reed valve assembly comprises a reed valve plate with at least one orifice, the reed valve plate selected according to a rated compressor displacement, a retainer portion; and a reed retained by the retainer portion proximate to the reed valve plate and oriented to inhibit air flow through the at least one orifice in a closed state. The reed valve assembly is removably secured to the valve plate.

Figure 5:
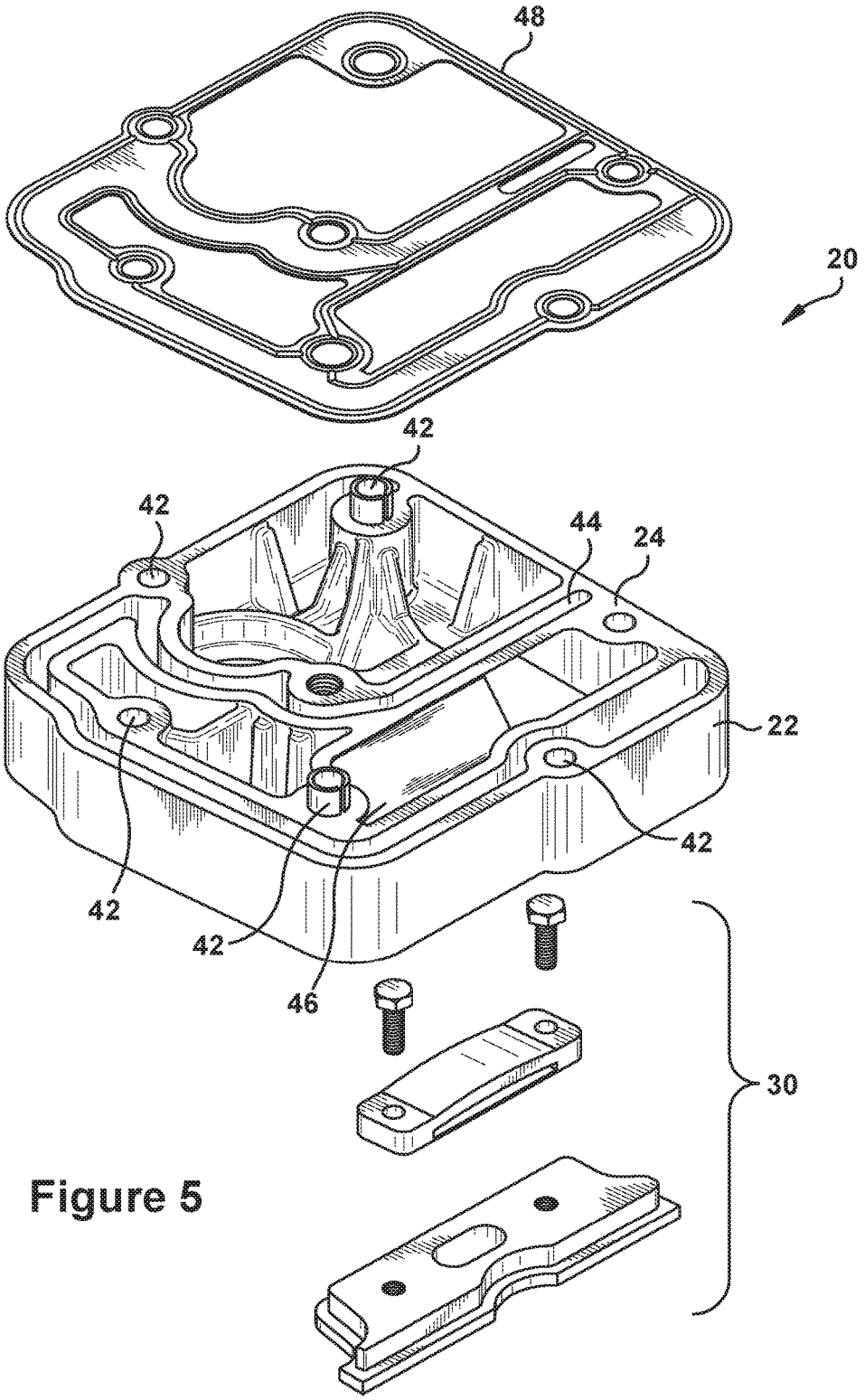
FIG. 5 illustrates an exploded view from the top of the valve plate assembly.

FIG. 5 illustrates an exploded view of the valve plate assembly 20 and a head gasket 48 from a top assembly view. The valve plate 22 includes cooling channels 44 and a baffle section 46 on the first face 24 that is possible because the valve plate 22 is no longer dedicated to mounting of the reed valve, as in prior assemblies. With the reed valve assembly 30 being mounted from the second face 26 of the valve plate 22, there is more space in the valve plate 22. Only the single head gasket 48 is necessary to seal and further direct air and coolant as opposed to a gasket between the valve plate and the cooling plate as in prior assemblies.

Figure 6:
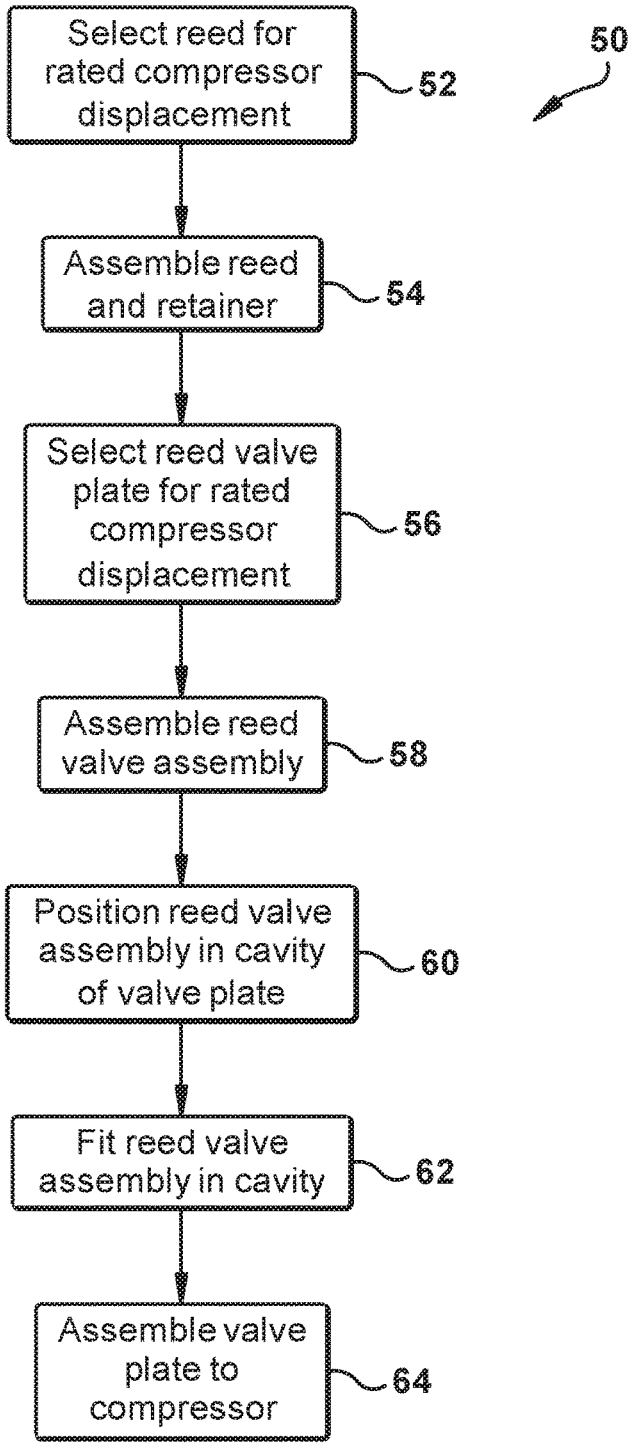
FIG. 6 illustrates a method of assembling a compressor head with the reed valve assembly according to an example of the invention.

FIG. 6 illustrates a method 50 of assembling the valve plate assembly 20 to a compressor. The method 50 begins with step 52 with the selection of a reed for the rated compressor displacement. In step 54 the reed 14 and retainer 12 are assembled to create the reed valve 10. The reed 14 is constrained by the retainer 12 as shown in FIG. 2*a* or by the retainer 12' and fasteners 16 and nuts 18 as shown in FIG. 2*b*.

In step 56, a reed valve plate 32 is selected based on the rated compressor displacement. In one example, the at least one orifice 38 includes two separate orifices when the rated compressor displacement is relatively large, such as 425 cc. The two separate orifices permit larger air flow for the greater amount of compressed air. The shape and size of the at least one orifice 38 can be selected as well to improve air flow based on the rated compressor displacement. The shapes may include oval, round or tapered shapes.

In step 58, the reed valve 10 is fastened to the reed valve plate 32 to create the reed valve assembly 30. The reed 14 is positioned over the at least one orifice 38 of the reed valve plate 32. A gasket 34 may be installed on the upper surface of the reed valve plate 32 prior to affixing the reed 14 and retainer 12.

The method 50 continues with step 60 when the reed valve assembly 30 is positioned to fit within the cavity 28 of the valve plate 22.

In step 62, the reed valve assembly 30 is pushed into the cavity 28. The reed valve assembly 30 is held by an interference fit in the cavity 28 so that any motion of the valve plate assembly 20 will not cause the reed valve assembly 30 to become loosened in the cavity 28.

In another embodiment, the reed valve assembly 30 may not be fully assembled until the components are placed in the cavity 28. In one example, the valve retainer 12 is placed in the cavity 28, then the reed 14, and then the reed valve plate 32 is inserted in the cavity 28. The fasteners 16 are then inserted to create the reed valve assembly 30 by holding the assembly together.

In step 64, the valve plate assembly 20 is assembled to the compressor between a compressor crankcase and a cylinder head in a known manner. Mounting holes 42 in the valve plate 22 may be used to hold the valve plate assembly 20 and the head gasket 48 to the crankcase. The orifice 38 of the reed valve assembly 30 will communicate with a discharge orifice in the compressor. When the reed 14 is in a closed state, the reed 14 will not permit air to pass through the discharge orifice. When a pressure exceeding pressure on the upper side of the reed 14 is present, the reed 14 will be in an open state and the air will pass through the orifice 38 of the reed valve plate 32 through the cavity 28 and into the air channels in the valve plate 22 to components downstream of the compressor. As pressure is increased on the lower side of the reed 14, the reed 14 will open at a positive pressure differential.

In case of any failure of the reed valve assembly 30, the reed valve assembly 30 is serviceable and can be simply removed from the valve plate assembly 20 by a technician. In addition, the reed valve assembly 30 can be modified to include different types of reeds that operating at different pressures. Changes to the valve plate 22 would not be required in order to install a reed valve assembly of varied type since the reed valve assembly is self-contained.

Therefore a method of assembling a compressor head comprises selecting a reed valve plate corresponding with a rated compressor displacement; selecting a reed corresponding with a rated compressor displacement; fastening the reed and a retainer portion to the reed valve plate to create a reed valve assembly; and removably securing the reed valve assembly in a cavity of a valve plate of the compressor head.

Therefore, the present compressor head assembly eliminates components formerly required in the prior art compressors, such as a separate cooling plate and second head gasket. The elimination of parts in the compressor head assembly helps minimize bore distortion, improve clamp load consistency, and minimize potential oil leakage at the crankcase. The reed and reed valve plate of the present inventive compressor head assembly can be selected according to the compressor displacement, such that the same valve plate may be used on multiple different compressors. The configuration of the present reed valve assembly and valve plate simplifies changing reed valve assemblies. The reed and reed valve plate are constructed of the same materials or materials with a similar hardness rating, which minimizes wear on the reed valve plate and increase the life of the reed valve assembly. The reed valve plate and retainer are constructed of the same materials or materials of similar thermal characteristics to minimize fatigue of the reed and retainer.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A compressor head assembly comprising:

a valve plate having a first face and a second face, wherein at least one cavity is located on the second face;

a reed valve assembly sized as a complementary shape of the at least one cavity to be fully contained in the at least one cavity; wherein the reed valve assembly comprises:

a reed valve plate with at least one orifice, wherein the reed valve plate comprises integral baffle features for separately directing coolant and air;

a retainer portion; and a reed retained by the retainer portion proximate to the reed valve plate and oriented to inhibit air flow through the at least one orifice in a closed state;

wherein the reed valve assembly is removably secured inside the at least one cavity of the valve plate and the reed valve plate is substantially flush with the second face of the valve plate when contained in the at least one cavity.

2. The compressor head assembly as in claim 1 wherein a number of the at least one orifice and a shape of the at least one orifice are selected according to a rated compressor displacement.

3. The compressor head assembly as in claim 1, wherein at least one of a number of the at least one orifice and a size of the at least one orifice is selected to be larger for a compressor with a relatively large rated compressor displacement than for a compressor with a relatively small rated compressor displacement.

4. The compressor assembly as in claim 1, wherein the reed valve assembly further comprises means for fastening the retainer portion and the reed to the reed valve plate.

5. The compressor head assembly as in claim 1, wherein the reed valve plate and the reed comprise substantially the same material.

6. The compressor head assembly as in claim 1, wherein the reed valve plate and the reed are each a material having a Brinell hardness of at least 90.

7. The compressor head assembly as in claim 1, wherein the retainer portion and the reed each comprise a material with substantially the same thermal expansion properties.

8. The compressor head assembly as in claim 1, wherein the reed valve assembly and the valve plate comprise different materials.

9. The compressor assembly as in claim 8, wherein the valve plate is aluminum and the reed valve assembly is steel.

10. The compressor head assembly as in claim 1, wherein the reed valve assembly is removably secured by an interference fit in the cavity.

11. The compressor head assembly as in claim 1, wherein the at least one cavity of the valve plate is in pneumatic communication with the at least one orifice of the reed valve plate when the reed is in an open state.

12. The compressor assembly as in claim 11, wherein the reed is in the open state when a pressure at a lower face of the reed valve plate is greater than a pressure at an upper face of the reed valve plate.

13. A compressor head assembly comprising:

a valve plate having a first face, a second face, integral baffle features for separately directing coolant and air located on the first face, and at least one cavity located on the second face;

a reed valve assembly sized to be contained in the at least one cavity; wherein the reed valve assembly comprises:

a reed valve plate with at least one orifice;

a retainer portion; and a reed retained by the retainer portion proximate to the reed valve plate and oriented to inhibit air flow through the at least one orifice in a closed state;

wherein the reed valve assembly is removably secured to and fully contained in the valve plate.

14. The compressor head assembly as in claim 13, wherein a number of the at least one orifice and a shape of the at least one orifice are selected according to a rated compressor displacement.

15. The compressor head assembly as in claim 13, wherein the reed valve plate and the reed comprise substantially the same material.

16. The compressor head assembly as in claim 13, wherein the reed valve plate and the reed each comprise a material with substantially the same thermal expansion properties.

17. The compressor head assembly as in claim 13, wherein the reed valve assembly and the valve plate comprise different materials.

18. A method of assembling a compressor head comprising:

selecting a reed valve plate, wherein the reed valve plate comprises integral baffle features for separately directing coolant and air;

fastening a reed and a retainer portion to the reed valve plate to create a reed valve assembly; and removably securing the reed valve assembly in a complementary shaped cavity of a valve plate of the compressor head until the reed valve assembly is substantially flush with a lower face of the valve plate when contained in the cavity.

19. The method as in claim 18, wherein removably securing comprises press fitting the reed valve assembly in the cavity.

20. A compressor head assembly comprising:

a valve plate having a first face and a second face, at least one cavity located on the second face and means for separately directing coolant and air located on the first face;

a reed valve assembly sized to be fully contained in the at least one cavity; wherein the reed valve assembly comprises:

a reed valve plate with at least one orifice;

a retainer portion;

a reed retained by the retainer portion proximate to the reed valve plate and oriented to inhibit air flow through the at least one orifice in a closed state; and means for removable securing the reed valve assembly to the valve plate at the second face.

* * * * *